US007415920B2

(12) United States Patent
Knauth et al.

(10) Patent No.: US 7,415,920 B2
(45) Date of Patent: Aug. 26, 2008

(54) RADIAL PISTON PUMP

(75) Inventors: Werner Knauth, Lohr am Main (DE); Uwe Nigrin, Ilmenau (DE); Ngoc-Tam Vu, Ludwigsburg (DE)

(73) Assignee: Siemens Aktiengesellschaft, München (DE)

( * ) Notice: Subject to any disclaimer, the term of this patent is extended or adjusted under 35 U.S.C. 154(b) by 388 days.

(21) Appl. No.: 11/220,489

(22) Filed: Sep. 7, 2005

(65) Prior Publication Data

US 2005/0287016 A1 Dec. 29, 2005

Related U.S. Application Data

(63) Continuation of application No. PCT/EP2004/001702, filed on Feb. 20, 2004.

(30) Foreign Application Priority Data

Mar. 7, 2003 (DE) ..... 103 10 123

(51) Int. Cl.
*F04B 1/04* (2006.01)
*F02M 41/00* (2006.01)

(52) U.S. Cl. ..... 92/171.1; 92/72

(58) Field of Classification Search ..... 92/72, 92/171.1; 91/491; 417/273
See application file for complete search history.

(56) References Cited

U.S. PATENT DOCUMENTS

| | | | | |
|---|---|---|---|---|
| 6,139,284 | A * | 10/2000 | Streicher | 417/273 |
| 6,224,351 | B1 | 5/2001 | Simon et al. | 417/273 |
| 6,439,859 | B1 * | 8/2002 | de Matthaeis et al. | 417/273 |
| 6,446,604 | B1 * | 9/2002 | Guentert et al. | 92/72 |
| 6,450,788 | B1 | 9/2002 | Grabert | 417/570 |
| 6,514,050 | B1 * | 2/2003 | Streicher | 417/273 |

FOREIGN PATENT DOCUMENTS

| | | |
|---|---|---|
| DE | 2135905 | 1/1973 |
| DE | 2628590 A1 | 1/1977 |
| DE | 2628591 A1 | 1/1977 |
| DE | 19526268 A1 | 1/1997 |

(Continued)

OTHER PUBLICATIONS

International Search Report for International Application No. PCT/EP2004/001702 (1 page), Jun. 4, 2004.

(Continued)

*Primary Examiner*—Thomas E Lazo
(74) *Attorney, Agent, or Firm*—Baker Botts L.L.P.

(57) ABSTRACT

A radial piston pump for generation of high fuel pressures in fuel injection systems comprises a pump housing, a pump shaft and at least one cylinder insert, arranged radially to the pump shaft. A cylinder chamber is located within the cylinder insert in which a piston can move back and forth. The cylinder insert is connected with a front face to a flattening of the pump housing, by connecting means. The cylinder insert comprises an inlet port and a high pressure port. The front face of the cylinder insert and/or the flattening of the pump housing comprise precisely machined raised sealing regions for sealing the cylinder insert against the pump housing, which are relatively small in relation to the total front face of the cylinder insert and the total flattening of the pump housing. A high surface pressure is thus achieved in the sealing region.

17 Claims, 2 Drawing Sheets

FOREIGN PATENT DOCUMENTS

| | | | |
|---|---|---|---|
| DE | 19848040 | A1 | 4/2000 |
| DE | 19914720 | A1 | 11/2000 |
| DE | 19841642 | C2 | 7/2002 |
| EP | 1 065 369 | A2 | 6/2000 |
| EP | 1065369 | A2 | 1/2001 |
| EP | 1148234 | A2 | 10/2001 |
| EP | 1184572 | A2 | 3/2002 |
| EP | 1225328 | A2 | 7/2002 |
| JP | 08270530 | A | 10/1996 |
| WO | 99/15782 | | 4/1999 |

OTHER PUBLICATIONS

International Search Report & Written Opinion (w/translation); PCT/EP2004/001702, 8 pp, May 26, 2004.

* cited by examiner

RADIAL PISTON PUMP

CROSS-REFERENCE TO RELATED APPLICATIONS

This application is a continuation of co-pending International Application No. PCT/EP2004/001702 filed Feb. 20, 2004, which designates the United States of America, and claims priority to German application number 103 10 123.3 filed Mar. 7, 2003, the contents of which are hereby incorporated by reference in their entirety.

TECHNICAL FIELD

The invention relates to a radial piston pump for generation of high fuel pressures in fuel injection systems.

BACKGROUND

DE 198 41 642 C2 discloses a high pressure fuel pump comprising a pump housing and several cylinder heads designed as cylinder inserts. Each cylinder insert is fixed in the pump housing via a spigot. An inlet line leads from the pump housing into the cylinder head. The fuel flows from the inlet line via an inlet valve into the cylinder chamber where it is compressed and finally flows, via a high pressure valve and a high pressure line, back to the pump housing, from where it flows to a common high pressure storage tank, the so-called common rail. An O-ring is arranged between the cylinder insert and the pump housing. The cylinder insert has a groove to accommodate the O-ring seal. The insertion of the O-ring requires a high assembly cost and it is easily possible for the O-ring to be positioned wrongly in the groove. When the cylinder insert is screwed in place, the O-ring is squashed between the sealing faces of the two components and is thus damaged, thereby allowing fuel to flow out of the high pressure fuel pumps.

SUMMARY

The object of the invention is thus to ensure a reliable seal of the high pressure fuel pumps in the case of a simple assembly of the cylinder insert.

The object can be achieved by a radial piston pump for generation of high fuel pressures in fuel injection systems, comprising a pump housing, a pump shaft, at least one cylinder insert comprising a cylinder chamber in which a piston can move back and forth, and a front face lying on a flattening of the pump housing and connected to it using connecting means, wherein the front face of the cylinder insert and/or the flattening of the pump housing have precisely machined raised sealing areas which are small in comparison to the total front face of the cylinder insert and to the total flattening of the pump housing, as a result of which a high surface pressure can be achieved in the sealing area, and at least one inlet channel, through which the fuel can flow into the cylinder chamber, at least one high pressure channel, through which the fuel can flow out of the cylinder chamber, wherein the inlet channel and the high pressure channel end in the front face of the cylinder insert, and a first corresponding channel and a second corresponding channel arranged in the pump housing, ending in the flattening of the pump housing and are essentially aligned with the inlet channel and the high pressure channel respectively.

The at least one cylinder insert can be arranged radially to the pump shaft. A first raised sealing area can be configured around the inlet channel and a second raised sealing area is configured around the high pressure channel. The first and second raised sealing areas can be essentially configured annularly around the centre of the inlet channel and of the high pressure channel respectively. An additional third raised sealing area can be configured around the first and second sealing area, and completely surrounds the two sealing areas. In the flattening of the pump housing, within the area surrounded by the third sealing area, an outlet channel can be configured, for draining a possible leak from the first and/or second sealing area and for monitoring the sealing system. An additional elastomer seal can be arranged around the high pressure channel. The elastomer seal can be circumference by a support ring.

The invention is characterised in that a front face of the cylinder insert is arranged on a flattening of the pump housing and that the front face of the cylinder insert or the flattening of the pump housing have precisely machined raised sealing areas, which are small in comparison with the total front face of the cylinder insert as well as with the total flattening of the pump housing, as a result of which a high surface pressure can be achieved in the sealing area. This avoids the use of an additional O-ring, as a result of which the assembly of the cylinder insert is greatly simplified. Damage to the sealing surface during assembly is avoided as far as possible.

One preferred embodiment of the invention provides that a first raised sealing area is configured around the inlet channel and a second raised sealing area is configured around the high pressure channel. As a result, the raised sealing areas can be designed to be as small as possible, as a result of which a high surface pressure is possible.

A further preferred embodiment of the invention provides that an additional third raised sealing area is configured around the first and the second sealing area, which completely surrounds the two sealing areas. This ensures that no fuel can flow outwards via the sealing surfaces in the event of a leak in the first and/or the second sealing area, but the impermeability remains thanks to the third surrounding sealing area.

BRIEF DESCRIPTION OF THE DRAWINGS

Exemplary embodiments of the invention are explained below with reference to the schematic drawings, in which.

DETAILED DESCRIPTION

Figure 1:
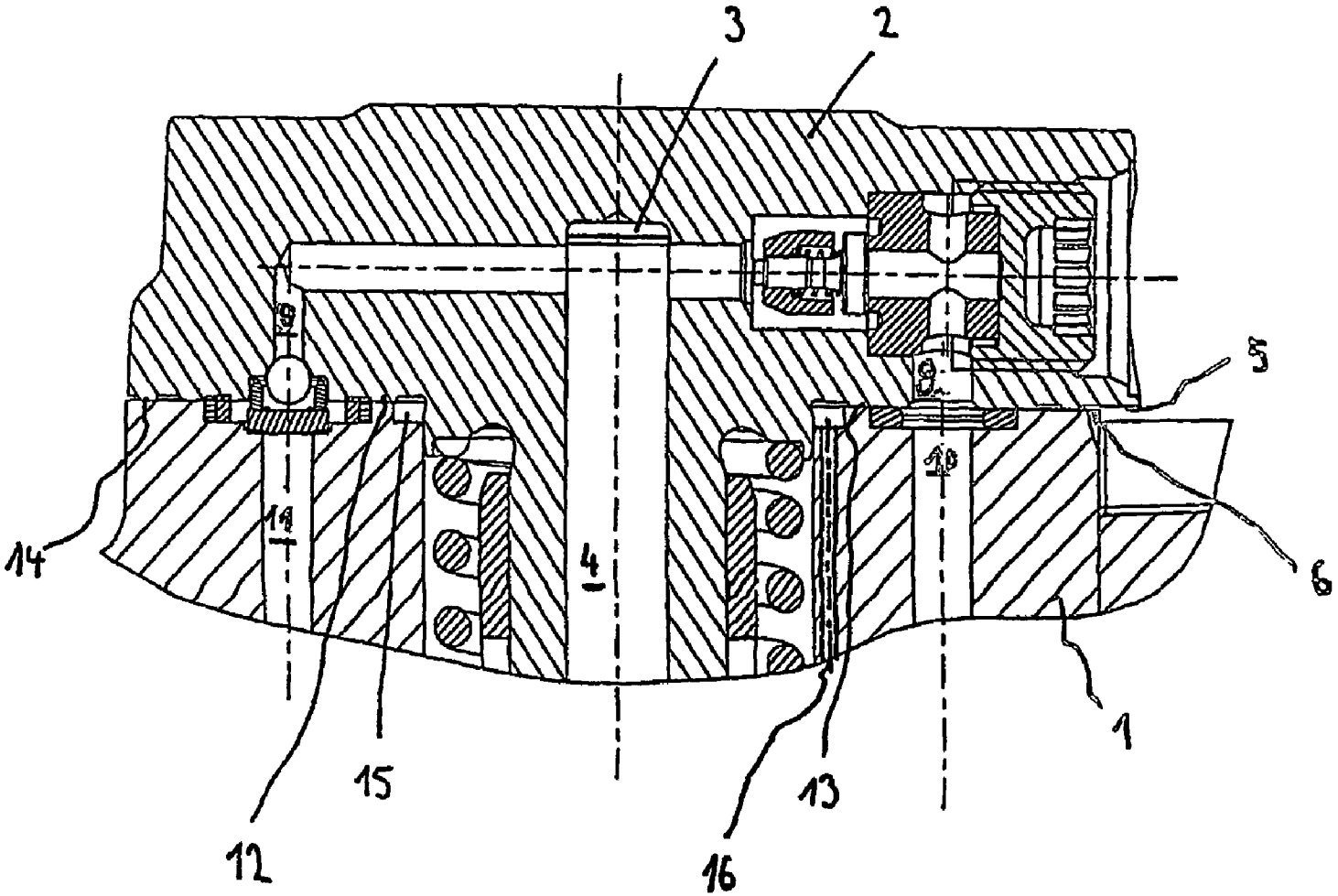
FIG. 1 shows a detailed view of the high pressure fuel pump according to the invention

FIG. 1 shows a detailed view of the high pressure fuel pump. The drawing shows a part of the pump housing 1 and a cylinder insert 2. Typically a number of cylinder inserts, preferably three, are provided, offset at an angle of 120° from one another. The cylinder insert 2 is fixed in the pump housing 1 via a spigot and is arranged with a front face 5 lying on a flattening 6 of the pump housing. The cylinder insert 2 is connected to the pump housing 1 via connecting means (not shown), preferably screws. An inlet channel 8 as well as a high pressure channel 9 are introduced into the cylinder inset 2, each of which flow into the front face 5. The pump housing 1 has a first channel 10 corresponding to the inlet channel 8, as well as a second channel 11 corresponding to the high pressure channel 9, which flow into the flattening 6 of the pump housing 1. The first channel 10 is arranged essentially in alignment with the inlet channel 8 and the second channel 11 is arranged essentially in alignment with the high pressure channel 9.

The fuel flows from the pump housing 1, via the first channel 10 to the inlet channel 8 and via an inlet valve into the cylinder chamber 3. The fuel is compressed there and then flows to a common high pressure storage (not shown) via a high pressure valve, the high pressure channel 9 and the second channel 11.

The front face 5 of the cylinder insert 2, which rests on the flattening 6 of the pump housing 1, has a number of raised regions 12, 13, 14. By means of the raised regions 12, 13, 14, the sealed area, i.e. the support surface on the flattening 6, is reduced such that a significantly higher surface pressure is achieved with the same starting traction as in the case of a level front face. In this way, a more secure seal of the cylinder insert 2 is achieved in comparison with the pump housing 1. Naturally it is also possible to configure the raised regions in the flattening 6 of the pump housing 1. It is also possible to configure the raised regions both in the cylinder insert 2 and in the pump housing 1. For reasons of cost, it is however advantageous to provide the raised sealing areas only in one component and to configure the corresponding surface as a flat surface. The flat sealing surface does not need to be of high quality in this case as the high surface pressures enable the irregularities to be evened out because of the elastic deformation of the material in the region of the sealing surface.

In the exemplary embodiment shown in FIG. 1, the first raised sealing surface 12 is configured around the inlet channel 8 and the second raised sealing surface 13 around the high pressure channel 9. In this way, the sealing force is precisely introduced into the vicinity of the regions to be sealed. The sealing surface can thus be minimised, which results in a high surface pressure in the sealing area.

In addition to the first and second raised sealing areas 12, 13, an additional third raised sealing area 14 is configured which completely surrounds the two sealing areas 12, 13. This ensures that if there is a leak in the first and/or second sealing area, no fuel can escape through the sealing surfaces but the seal is still maintained by means of the third surrounding sealing area. By means of the third raised sealing area 14 completely surrounding the first and second sealing area 12, 13, a hollow space 15 is formed, in which the fluid can run off if there is a leak in the first and/or second sealing region 12, 13. An outlet channel 16 is preferably provided so that no fluid pressure can build up within the hollow space 15. The fuel can flow back to the fuel tank via the outlet channel 16. The hollow chamber 14 can simultaneously also be used for monitoring purposes. For this purpose, a corresponding sensor can be arranged within the hollow chamber, which emits a signal to a corresponding evaluation unit if there is a leak in the first and/or second sealing area 12, 13.

Figure 2:
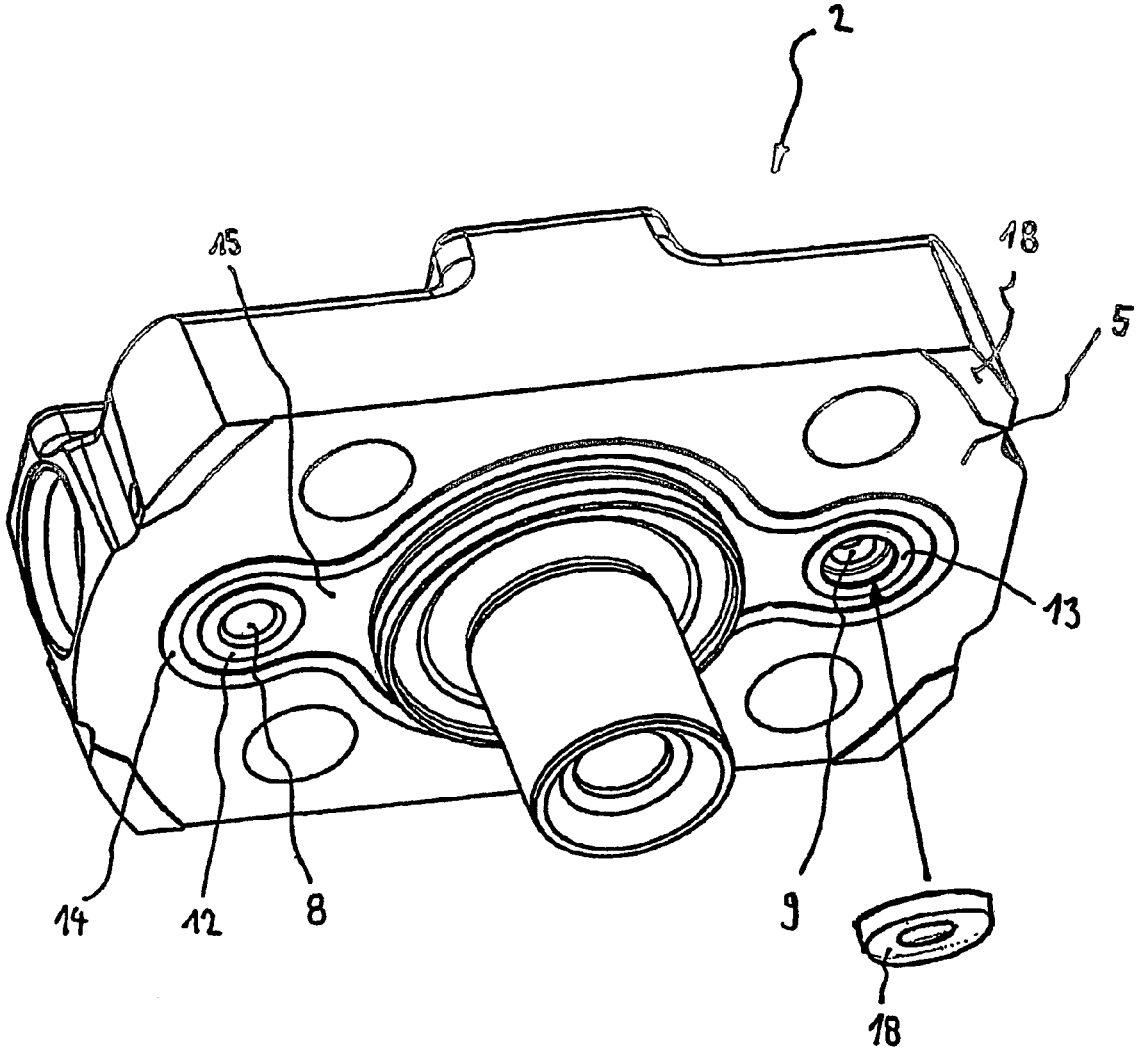
FIG. 2 shows an exploded view of a cylinder insert according to the invention

FIG. 2 shows an exploded view of the cylinder insert 2 used in FIG. 1, with a first raised sealing area 12 and a second raised sealing area 13. The first and second raised sealing area 12, 13 is configured essentially annularly around the centre of the inlet channel 8 and/or of the high pressure channel 9. The two raised sealing areas 12, 13 are completely surrounded by a third raised sealing area 14. If there is a leak in one of the two sealing surfaces, the fuel can run off into the hollow chamber 15 and can flow back to the fuel tank via the outlet channel 16. As is clear from the figure, the precisely machined raised sealing areas 12, 13, and 14 are small in relation to the total front face 5 of the cylinder insert 2. In this way, a high surface pressure in the sealing area results and thus a more secure seal.

With very high fuel pressures, an elastomer seal can also be provided in the region of the high pressure channel 9. The elastomer seal is preferably arranged together with a support ring 18 centrically in a recess (not shown) around the high pressure channel 9.

To prevent a tilting of the cylinder insert 2 when it is connected to the pump housing 1, four support surfaces 18 are provided, preferably on the external corners of the front face 5.

The sealing contour can be advantageously manufactured by electrochemical ablation processes, by a silk printing method, by etching, erosion or surface stamping. The raised regions preferably stand 0.1 to 0.3 mm proud. This ensures that when the cylinder insert is connected to the pump housing, only the raised regions have contact and the remaining surfaces do not touch. At the same time not much material needs to be ablated, as a result of which processing does not take long.

The proposed invention thus ensures a more secure seal of the cylinder insert against the pump housing. The raised surface regions and the high surface pressures achievable thereby give rise to a high sealing force. Additional sealing elements, e.g. O-rings, are not necessary. As a result, assembly is greatly simplified and incorrect assembly is excluded as much as possible. An additional third raised sealing area which surrounds the first and second sealing area ensures that even if there is a leak, the fuel cannot escape from the pump housing.

The invention is naturally not limited to the exemplary embodiments. In particular, different configurations of the raised sealing areas are possible. Thus, the raised sealing areas can for instance be of different heights, as a result of which a higher surface pressure can be introduced into the high pressure region than in the low pressure region.

What is claimed is:

1. A radial piston pump for generation of high fuel pressures in fuel injection systems, comprising:

a pump housing, a pump shaft, at least one cylinder insert comprising:

a cylinder chamber in which a piston can move back and forth, a front face lying on a flattening of the pump housing and connected to it using connecting means, wherein the front face of the cylinder insert and/or the flattening of the pump housing have precisely machined first and second raised sealing areas which are small in comparison to the total front face of the cylinder insert and to the total flattening of the pump housing, as a result of which a high surface pressure can be achieved in the sealing area, at least one inlet channel, through which the fuel can flow into the cylinder chamber, at least one high pressure channel, through which the fuel can flow out of the cylinder chamber, wherein the inlet channel and the high pressure channel end in the front face of the cylinder insert, and a first corresponding channel and a second corresponding channel arranged in the pump housing, ending in the flattening of the pump housing and are essentially aligned with the inlet channel and the high pressure channel respectively, wherein the first and second raised sealing areas are essentially configured annularly around the centre of the inlet channel and of the high pressure channel, respectively.

2. A radial piston pump according to claim 1, wherein the at least one cylinder insert is arranged radially to the pump shaft.

3. A radial piston pump according to claim 1, wherein an additional third raised sealing area is configured around the first and second sealing area, and completely surrounds the two sealing areas.

4. A radial piston pump according to claim 3, wherein in the flattening of the pump housing, within the area surrounded by the third sealing area, an outlet channel is configured, for draining a possible leak from the first and/or second sealing area and for monitoring the sealing system.

5. A radial piston pump according to claim 1, wherein an additional elastomer seal is arranged around the high pressure channel.

6. A radial piston pump according to claim 5, wherein the elastomer seal is configured as a ring seal and is supported at its external circumference by a support ring.

7. A radial piston pump for generation of high fuel pressures in fuel injection systems, comprising:

a pump housing, a pump shaft, a cylinder insert comprising:

a cylinder chamber in which a piston can move back and forth, a front face connected on a flattening of the pump housing, wherein the front face has a precisely machined first and second raised sealing area which is small in comparison to the front face, as a result of which a high surface pressure can be achieved in the sealing area, at least one inlet channel, through which the fuel can flow into the cylinder chamber, at least one high pressure channel, through which the fuel can flow out of the cylinder chamber, wherein the inlet channel and the high pressure channel end in the front face, wherein the first and second raised sealing areas are essentially configured annularly around the centre of the inlet channel and of the high pressure channel, respectively, and a first corresponding channel and a second corresponding channel arranged in the pump housing, ending in the flattening of the pump housing and essentially aligned with the inlet channel and the high pressure channel respectively.

8. A radial piston pump according to claim 7, wherein the flattening of the pump housing has a precisely machined raised sealing area which is small in comparison to the front face.

9. A radial piston pump according to claim 7, wherein the at least one cylinder insert is arranged radially to the pump shaft.

10. A radial piston pump according to claim 7, wherein an additional third raised sealing area is configured around the first and second sealing area, and completely surrounds the two sealing areas.

11. A radial piston pump according to claim 10, wherein in the flattening of the pump housing, within the area surrounded by the third sealing area, an outlet channel is configured, for draining a possible leak from the first and/or second sealing area and for monitoring the sealing system.

12. A radial piston pump according to claim 7, wherein an additional elastomer seal is arranged around the high pressure channel.

13. A radial piston pump according to claim 12, wherein the elastomer seal is configured as a ring seal and is supported at its external circumference by a support ring.

14. A radial piston pump for generation of high fuel pressures in fuel injection systems, comprising:

a pump housing, a pump shaft, a cylinder insert comprising:

a cylinder chamber in which a piston can move back and forth, a front face connected on a flattening of the pump housing, wherein the flattening has a precisely machined first and second raised sealing area which is small in comparison to the front face, as a result of which a high surface pressure can be achieved in the sealing area, at least one inlet channel, through which the fuel can flow into the cylinder chamber, at least one high pressure channel, through which the fuel can flow out of the cylinder chamber, wherein the inlet channel and the high pressure channel end in the front face, wherein the first and second raised sealing areas are essentially configured annularly around the centre of the inlet channel and of the high pressure channel, respectively, and a first corresponding channel and a second corresponding channel arranged in the pump housing, ending in the flattening of the pump housing and essentially aligned with the inlet channel and the high pressure channel respectively.

15. A radial piston pump according to claim 14, wherein the front face has aprecisely machined raised sealing area which is small in comparison to the front face.

16. A radial piston pump according to claim 14, wherein the at least one cylinder insert is arranged radially to the pump shaft.

17. A radial piston pump according to claim 14, wherein an additional third raised sealing area is configured around the first and second sealing area, and completely surrounds the two sealing areas.

* * * * *